US005911590A

United States Patent [19]

Kodama et al.

[11] Patent Number: 5,911,590

[45] Date of Patent: Jun. 15, 1999

[54] SECURING STRUCTURE FOR UNIT COMPONENT

[75] Inventors: Shinji Kodama; Hiroshi Yamashita; Hiroyuki Yokota, all of Shizuoka, Japan

[73] Assignee: Yazaki Corporation, Tokyo, Japan

[21] Appl. No.: 08/931,529

[22] Filed: Sep. 16, 1997

[30] Foreign Application Priority Data

Sep. 18, 1996 [JP] Japan ..... 8-246108

[51] Int. Cl.[6] ..... H01R 13/60; H01R 13/627

[52] U.S. Cl. ..... 439/364; 439/567

[58] Field of Search ..... 439/364, 466, 439/34, 36, 47, 50; 403/329; 267/141, 136; 188/72

[56] References Cited

U.S. PATENT DOCUMENTS 5,813,880 9/1998 Kodama ..... 439/364
5,836,787 11/1998 Kodama ..... 439/567

*Primary Examiner*—Neil Abrams
*Assistant Examiner*—Michael C. Zarroli
*Attorney, Agent, or Firm*—Armstrong, Westerman, Hattori, McLeland, Naughton

[57] ABSTRACT

A securing structure for a unit component comprising a first connector provided on all instrument panel and a second connector provided on the unit component and a sandwiching plate formed on the instrument panel the first and second connectors being connected to each other by tightening of a screw and nut and the sandwiching plate is sandwiched by both connectors so that the unit component is secured onto the instrument panel.

4 Claims, 8 Drawing Sheets

SECURING STRUCTURE FOR UNIT COMPONENT

BACKGROUND OF THE INVENTION

1. Field of the Invention

The present invention relates to a structure for securing a unit component such as a meter unit for a motor vehicle onto a panel such as an instrument panel by using tightening force of a connecting bolt.

2. Description of the Related Art

FIG. 11 is a conventional securing structure for a unit component for mounting and connector-connecting a meter unit (unit component) 84 to an instrument panel for a motor vehicle.

A pair of movable connectors 82 are installed inside a meter unit mounting portion 81 of an instrument panel 80. Outside the meter unit mounting portion 81, upper and lower total four brackets 83 for securing the meter unit 84 are protruded. The meter unit 84 is provided with a pair of fixed connectors 85 corresponding to the movable connectors 82 and four connecting bracket 86 corresponding to the brackets 83.

The meter unit 84 is inserted into the meter unit mounting portion 81 and secured there by screwing a bolt of each of the brackets 86 and 83. By rotating the bolts 88 on the side of the fixed connectors 85, the movable connectors 82 are disconnected from the instrument panel 80 and connected to the fixed connectors 85.

FIG. 12 shows a partially detailed plan view of the fitting state of the movable connector and fixed connector. Such a configuration is proposed in JP-A-8-22491.

A connector portion 35 of a movable connector 90 is movably held in a frame 33, elastic arms 36 extending in an axial direction of the frame 33 are engaged with panel holes 91, and elastic arms 37 extending in a radial direction of the frame 33 is brought into elastic contact with a panel portion 25 of the instrument panel 94. The movable connector 90 is provisionally engaged with the panel portions 25 by a protrusions 38 of the elastic arms 36, and provisionally engaged with the fixed connector 92 by protrusions 39 on the side of a nut 30.

The meter unit 93 is secured to the instrument panel 94 by the screw means such as bolts 32 so that the tip of a bolt 28 for connector connection of the fixed connector 92 has gone to the nut 30 of the movable connector 90. In this state, by rotating the bolt 28, the bolt 28 is screwed to the nut 30 so that the movable connector 90 is attracted and secured to the fixed connector 92.

However, each of the conventional securing structures described above requires plural (e.g. four) bolts 87, 32 for securing the meter unit 84, 93 to the instrument panel 8 and requires the bolt 88, 28 for coupling the connectors to each other. Thus, the conventional structures require many man-hours of bolt tightening and increases component cost for numerous bolts and nuts.

SUMMARY OF THE INVENTION

An object of the invention is to provide a securing structure for a unit component which can reduce the number of bolts required to mount a unit component to an instrument panel to decrease the component cost.

In order to attain the above object, in accordance with the present invention, there is provided a securing structure for a unit component comprising: a first connector provided on an instrument panel; a second connector provided on the unit component; said first and said connector being connected to each other by tightening of a screw means; a sandwiching plate formed on said instrument panel, said sandwiching plate being sandwiched by both connectors so that said unit component is secured onto said instrument panel. In this configuration, the first and said second connector sandwich the sandwiching plate so that the unit component can be firmly secured to the instrument panel. Thus, the securing means such as bolts used to secure the unit component to the instrument panel can be saved, thus reducing the man-hours of bolt tightening and the component cost.

Preferably, an elastic member covers said sandwiching plate, and said elastic member is sandwiched by said first and said second connector. In this configuration, backlash between the first and the second connector is absorbed by the elastic member so that the unit member is prevented from being vibrated and the unit component is firmly secured to the instrument panel by urging force of the elastic member.

Preferably, said sandwiching plate is extended in a direction of coupling said first and said second connector to each other, and is located inside said first connector, thus saving the space for attaching the unit component.

The above and other objects and features of the present invention will be more apparent from the following description taken in conjunction with the accompanying drawings.

DESCRIPTION OF THE PREFERRED EMBODIMENTS

Figure 1:
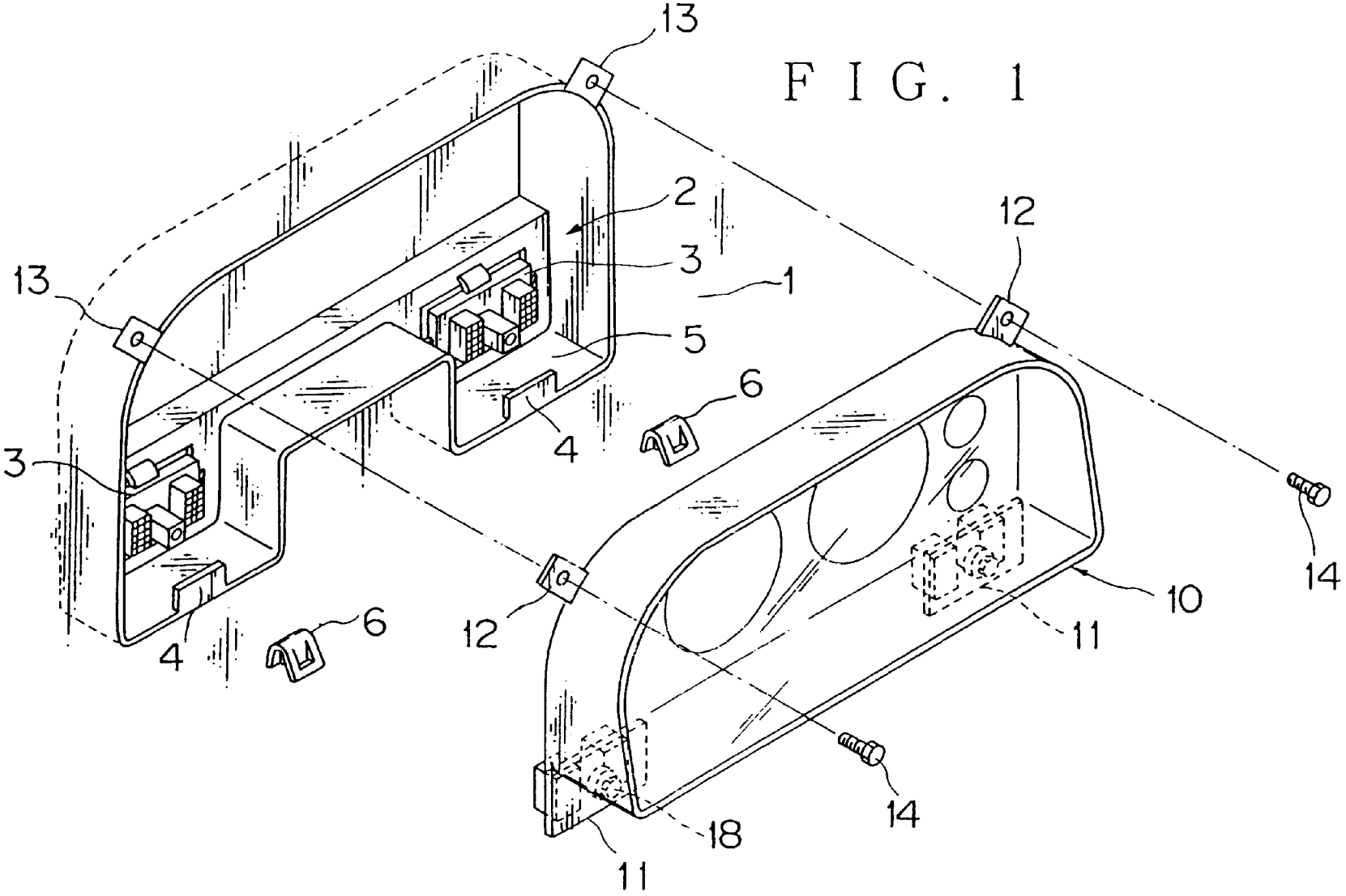
FIG. 1 is an exploded perspective view of the overview of a first embodiment of a securing structure for a unit component according to the present invention.

Now referring to the drawings, an explanation will be given of several embodiments of the present invention.

FIGS. 1 to 5 show the first embodiment of the securing structure for a unit component according to the present invention.

Figure 2:
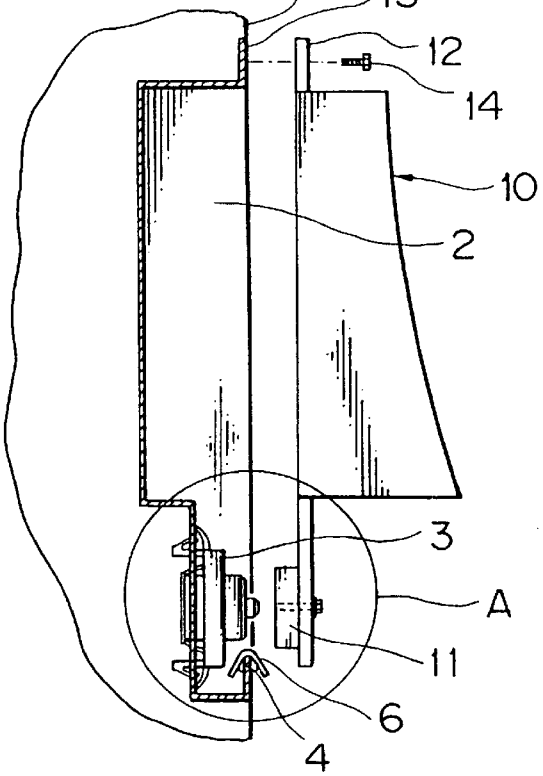
FIG. 2 is a longitudinal cross sectional view thereof.

As seen from FIGS. 1 and 2, like the prior art, a pair of movable connectors 3 are arranged in a meter unit mounting portion 2. At the forward position of each movable connector 3, a sandwiching plate 4 is arranged oppositely to the movable connector 3. The sandwiching plate 4 is integrally protruded from the instrument panel 1. The sandwiching plate is provided upright from the bottom wall 5 of the meter unit mounting portion 2. The sandwiching plate has a rectangular shape.

Figure 3:
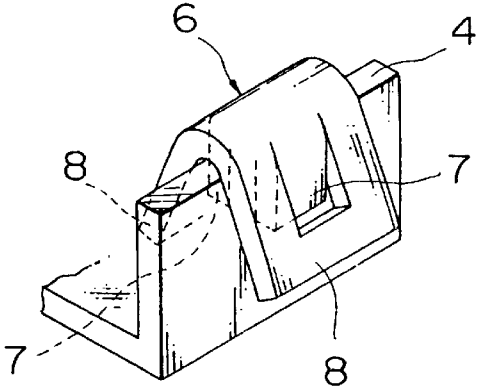
FIG. 3 is a perspective view of a structure in which a sandwiching plate is provided with a spring member.

A U- or V-shaped spring member 6 (elastic member) is mounted on each sandwiching plate 4. As shown in FIG. 3, the spring member 6 has a pair of sandwiching pieces 7 for the sandwiching plate 4, which are recessed from the central portion of the sandwiching plate. The sandwiching pieces 7 are fit over the sandwiching plate 4 so that the spring member 6 is secured onto the sandwiching plate 4. A pair of spring pieces 8 spreading outwardly from the sandwiching pieces 7 have outward urging force. The spring member 6 is generally made of metal or plastic.

In FIGS. 1 and 2, on the lower part of the meter unit 10, a pair of fixed connectors 11 corresponding to the pair of movable connectors 3 are arranged. Two securing brackets 12 and 13 are oppositely provided on the upper portion of the meter unit 10 and the meter unit attachment portion 2, respectively. In the prior art, four securing brackets are provided whereas in the present invention, no bracket are provided on the lower part of each of the meter unit 10 and the meter unit attachment portion 2. The brackets 12 and 13 are tightened by the screwing means such as a bolt 14.

Figure 4:
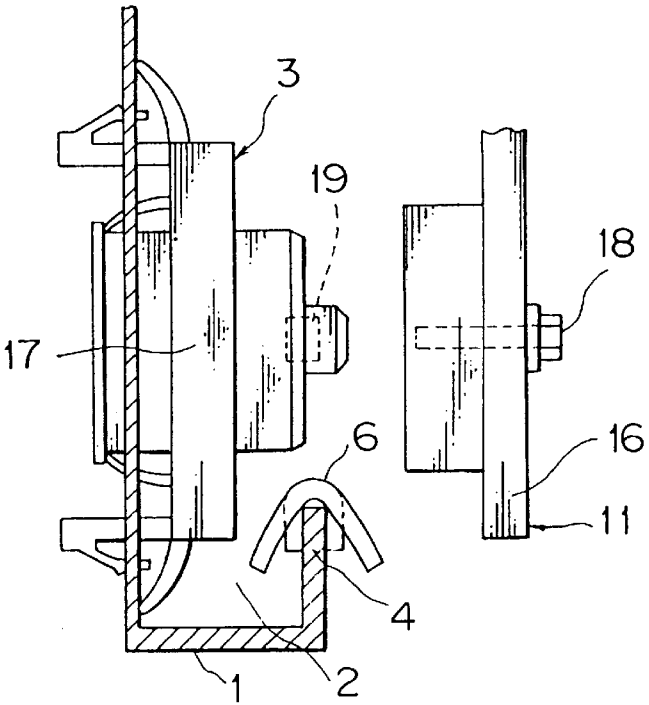
FIG. 4 is an enlarged view of part A of FIG. 2, showing the state before connector fitting.

As shown in FIG. 4 which is an enlarged view of part A in FIG. 2, the sandwiching plate 4 and spring member 6 of the instrument panel 1 are located between a base plate 16 of the fixed connector 11 and a frame 17 of the movable connector 3. The movable connector 3 is provided with a rotatable bolt 18 for connection (one screw means), and the fixed connector 11 is provided with a nut 19 (other screw means) corresponding to the bolt 18. As described later in connection with FIGS. 6 and 7, the movable connector 11 is provisionally engaged with the instrument panel 1.

Figure 5:
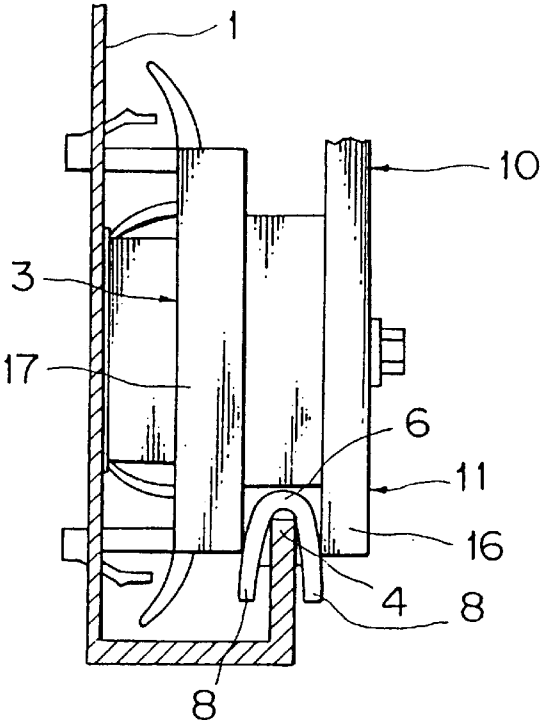
FIG. 5 is a longitudinal sectional view showing the securing state of the meter unit in connector fitting.

From the state of FIGS. 2 and 4, by pushing the meter unit 10 into the meter unit attachment portion 2 of the instrument panel 1 so that the bolt 18 is screwed to the nut 19, as shown in FIG. 5, both connectors 3 and 11 are coupled to each other. Thus, the sandwiching plate 4 is sandwiched between the base plate 16 of connector 11 and the frame 17 of connector 3 through a spring member 6. The spring member 6 (i.e. pair of spring members 8) is compressed toward the sandwiching plate 4 so that it is brought into intimate contact with the sandwiching plate 4 completely or with slight gap therebetween. In this way, the meter unit 10, including the fixed connector 11, is secured to the sandwiching plate 4 and hence the instrument panel 1.

As understood from the above description, as seen from FIG. 1, the lower brackets are not required in the meter unit 10, but the upper brackets 12 have only to be secured to the instrument panel 1. In this way, the meter unit 10 can be firmly secured to the instrument panel 1. For this reason, an operation of tightening the two bolts as compared with the prior art is not required so that the man-hours of working and cost of components can be reduced.

Incidentally, without using the spring member 6, only the sandwiching plate 4 may be sandwiched between connector 11 and connector 3. But, where the meter unit 10 is secured through the spring member 6, the pair of spring pieces 8 of the spring member 6 can absorb backlash between both connectors 3 and 11, and displacement between the fixed connector 3 and the sandwiching plate 4 so that they are always brought into intimate contact with both connectors 3 and 11. In this way, both connectors 3 and 11 are surely coupled with each other, and hence the meter unit 10 can be surely secured to the instrument panel 1.

Figure 6:
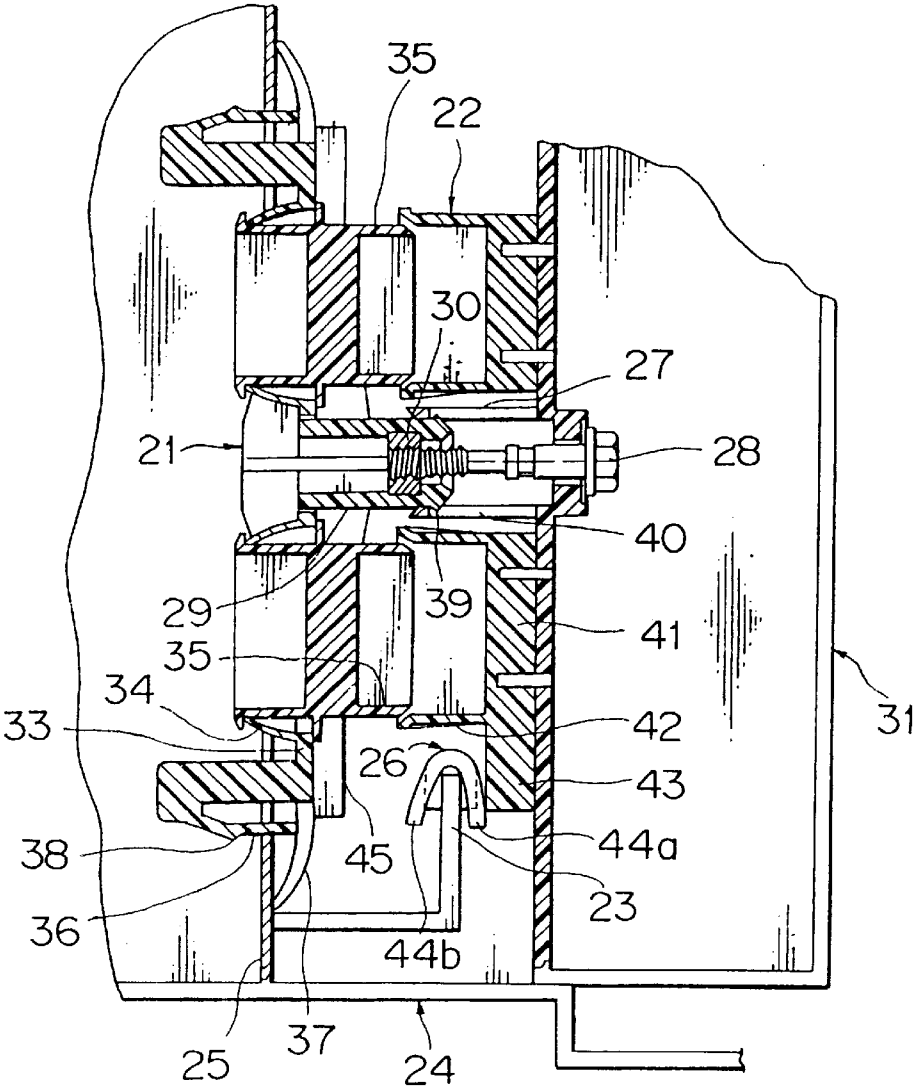
FIG. 6 is a detailed cross sectional view of an example similar to the first embodiment.
Figure 7:
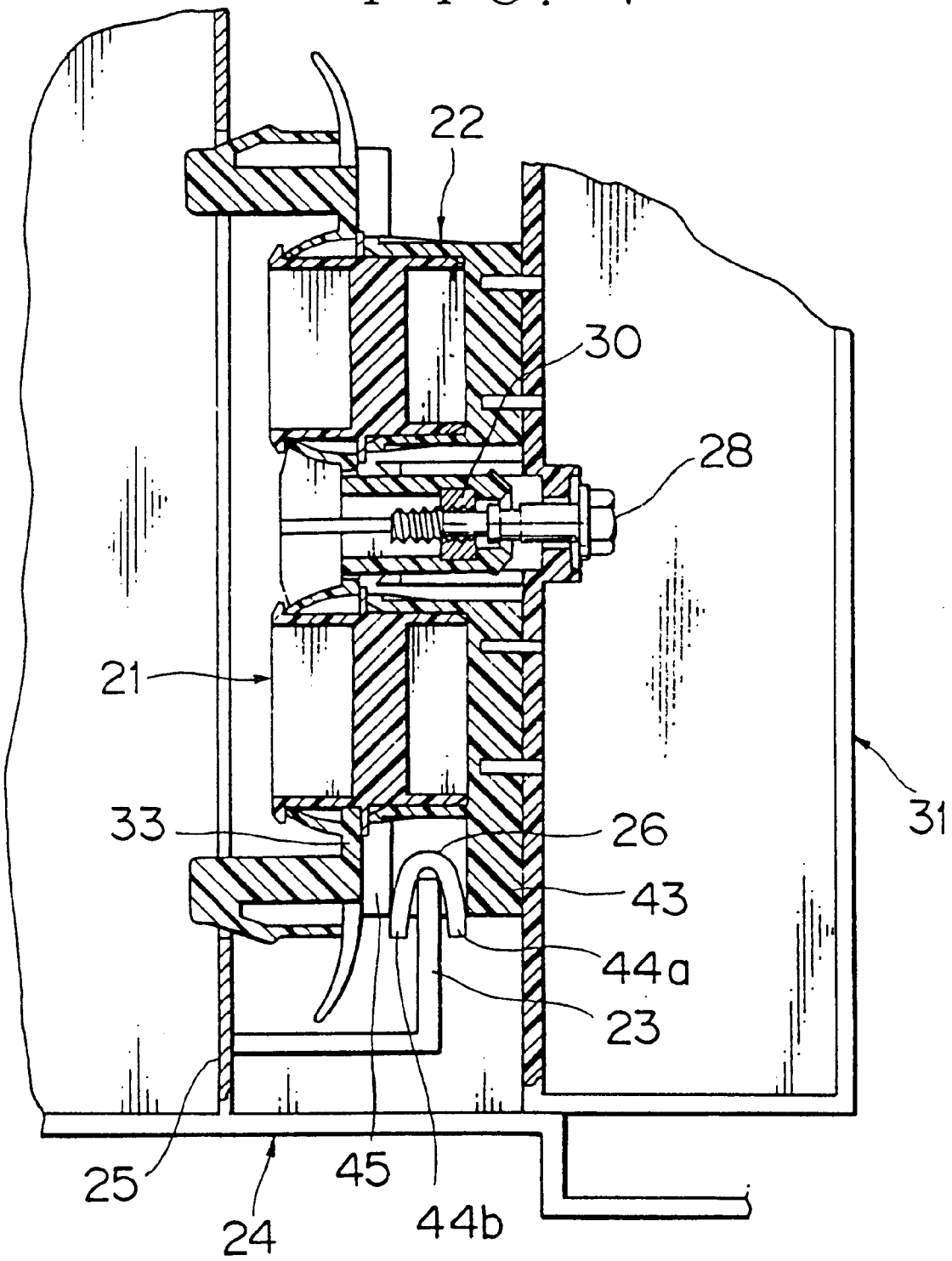
FIG. 7 is a cross sectional view of the securing state of a meter unit in connector fitting in FIG. 6.
Figure 12:
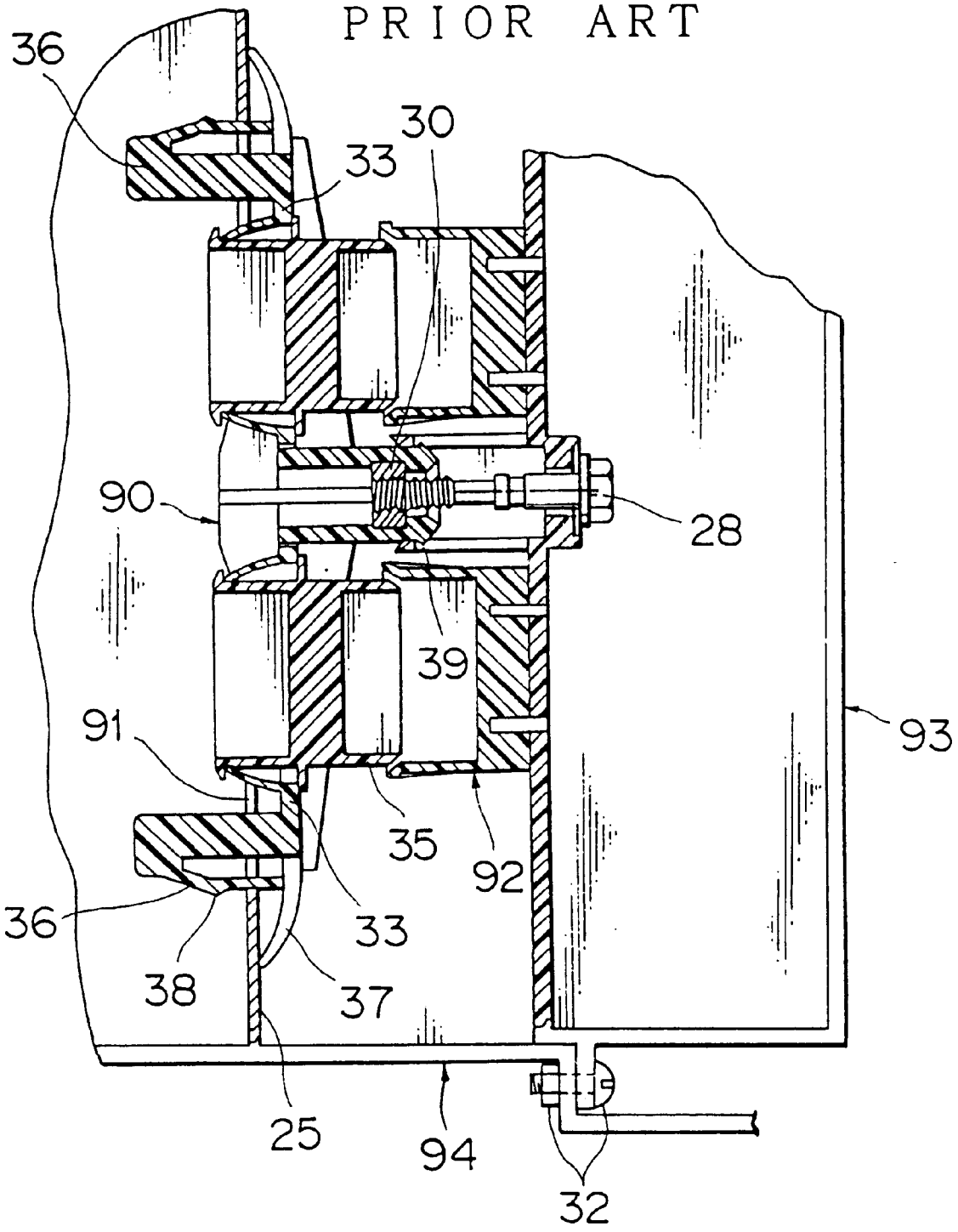
FIG. 12 PRIOR ART
FIG. 12 is a cross sectional view showing the securing state of a meter unit in FIG. 11.

FIGS. 6 and 7 show a modification of the above embodiment. In this example, connector 21 and connector 22 refer to like parts in the prior art (FIG. 12).

A sandwiching plate 23 is formed in an L-shape to protrude from a panel portion 25 of an instrument panel 24, and a spring member 26 is secured to the tip of the sandwiching plate 23. In FIG. 6, the connector 21 is provisionally engaged with the panel portion 25 so that the tip of a bolt 28 within a cylinder 27 of the connector 22 goes to a nut 30 of a guiding cylinder 29 of the connector 21. The connector 22 is secured to the meter unit 31. Unlike the prior art (FIG. 12), the screw means (32 in FIG. 12) for securing the meter unit 31 to the instrument panel 24 is not required.

The movable connector 21 includes a frame 33 of synthetic resin and plural (two in this example) male connector portions 35 held in the frame 33 by spring pieces 34 so that they are movable vertically and horizontally. The frame 33 is provided with elastic arms 36 and 37 in an axial and a radial direction thereof so that positional displacement of the movable connector 21 in the horizontal direction can be absorbed. The movable connector 21 is engaged with the panel portion 25 by a protrusion 38 of the elastic arm 36, and a protrusion 39 of the guiding cylinder 29 is engaged with a window 40. In this way, the movable connector 21 is provisionally engaged with the fixed connector 22.

The fixed connector 22 has two female connector potions 42 dangling from the frame 41. When the meter unit 31 is mounted onto the instrument panel 24, an extended portion 43 of the frame 41 is brought into elastic contact with the one spring piece 44*a* of a spring member 26. A part 45 of the frame 33 of the movable connector 21 is located in opposition to the other spring piece 44*b*.

As shown in FIG. 7, by rotating the bolt 28 so as to be screwed to the nut 30, the movable connector 21 is detached from the panel portion 25 and pulled to be coupled to the fixed connector 22. At the same time, the abutting portion 45 of the frame 33 of the movable connector 21 is brought into elastic contact with the other spring piece 44*b* of the spring member 26. Thus, the spring member 26 is sandwiched by the frame extending portion 43 of the fixed connector 22 and the frame abutting portion 45 of the movable connector 21. Accordingly, the meter unit 31 is secured to the instrument panel 24 with no backlash.

Figure 8:
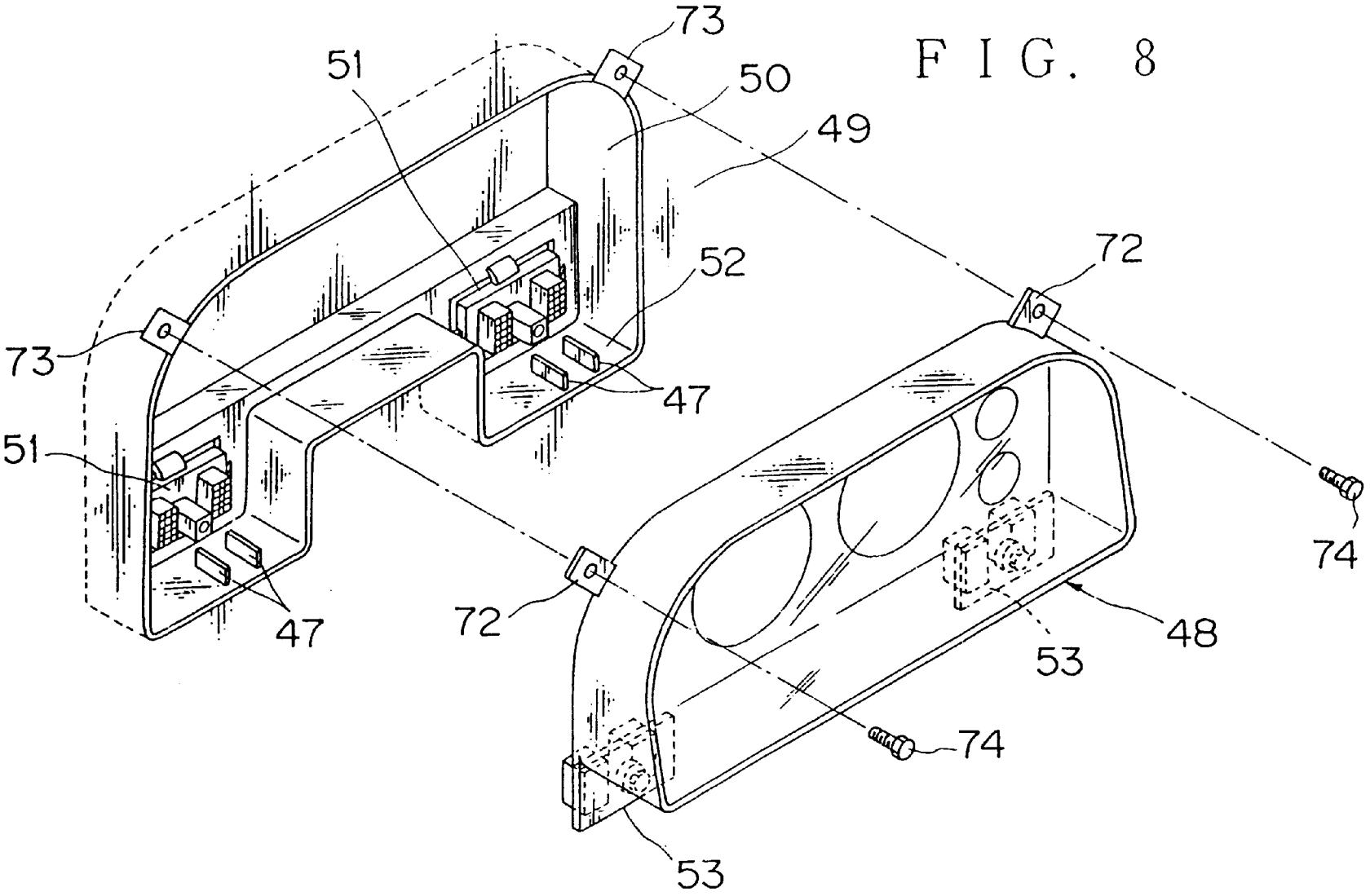
FIG. 8 is an exploded cross sectional view of the overview of a second embodiment of the present invention.
Figure 10:
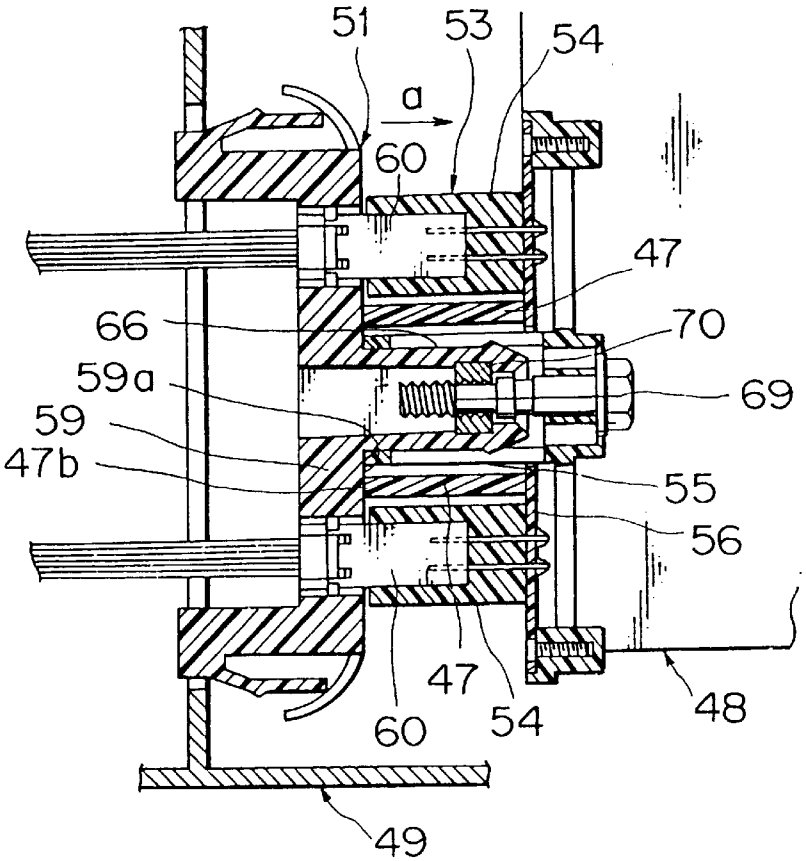
FIG. 10 is a cross sectional view showing the securing state of the meter unit in connector fitting in FIG. 8.
Figure 9:
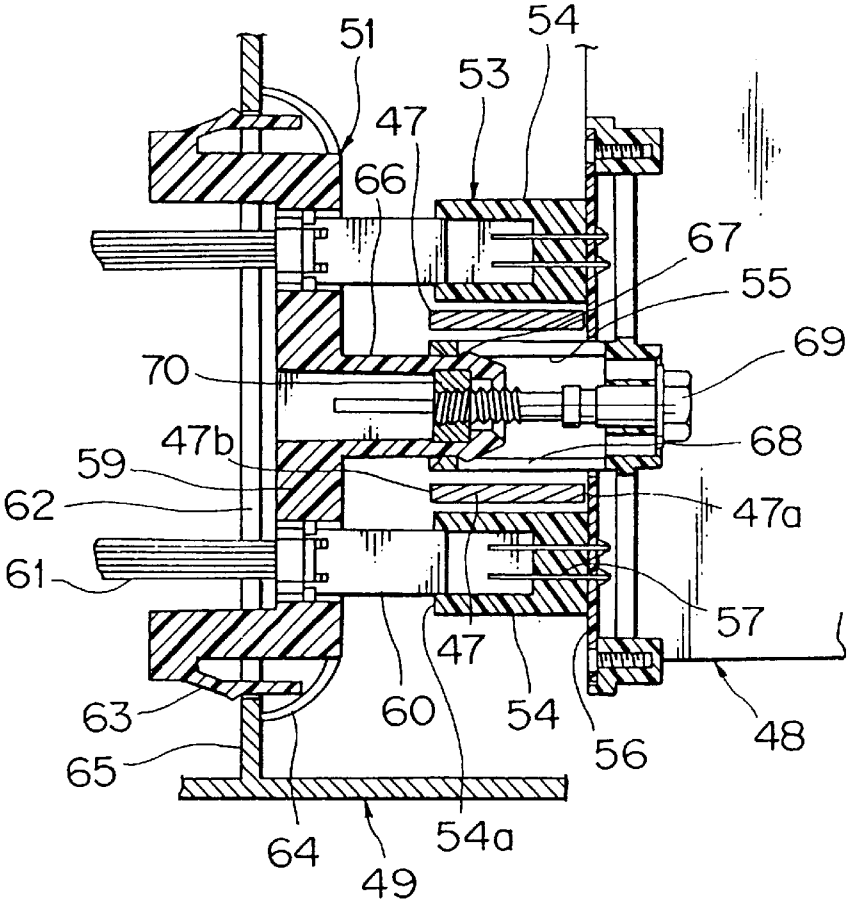
FIG. 9 is a cross sectional view showing the state before connector fitting in FIG. 8.
Figure 11:
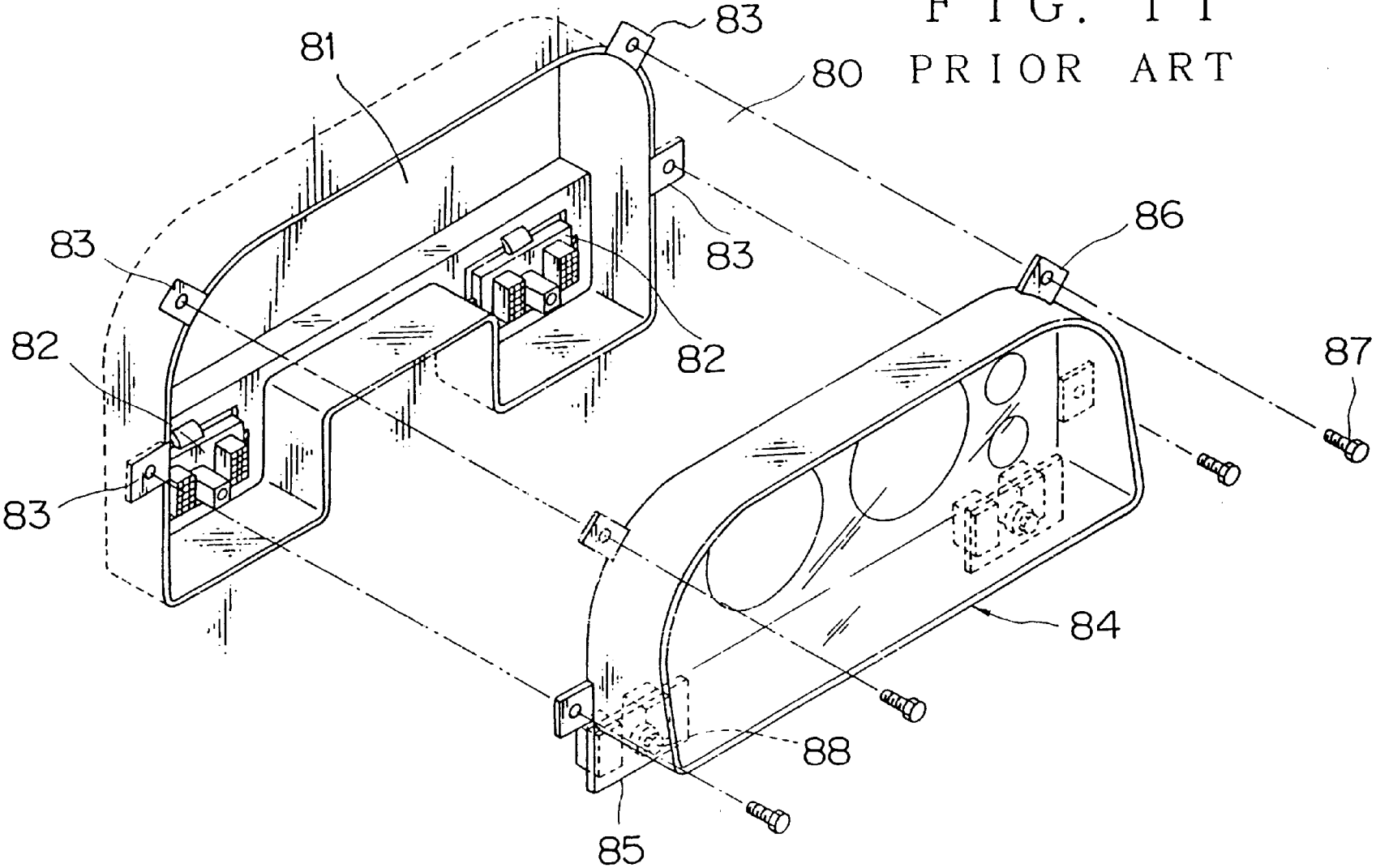
FIG. 11 PRIOR ART
FIG. 11 is an exploded view showing the overview of a prior art.

FIGS. 8 to 10 shows a second embodiment of the securing structure for a unit component.

In the configuration according to the second embodiment, a meter unit 48 is secured to an instrument panel 49 using each pair of rectangular sandwiching plates (sandwiching ribs) 47 extending in parallel in a back-and-forth direction instead of the sandwiching plate 4, 23 described above extending in a lateral direction.

As shown in FIG. 8, the sandwiching plates 47 are opposed to each other at the forward position of a movable connector 51. They are protruded upright from the bottom wall 52 of a meter unit mounting portion 50. The pair of sandwiching plates 47 are arranged for each movable connector 51.

With the meter unit 48 connected to the meter unit mounting portion 50, as shown in FIG. 9, the pair of sandwiching plates 47 have been located in the gaps between both female connector portions 54 on the fixed connector 53 on the side of the meter unit 48 and the central cylinder wall 55. The female connector portions 54 are formed upright on a circuit board (base plate) 56 secured to the meter unit 48 and male terminals 57 protruding therefrom. The front tip 47*a* of the sandwiching plate 47 goes to the circuit board 56. In this state, the rear tip 47*b* of the sandwiching plate 47 protrudes slightly further than the tip 54*a* of the female connector portion 54.

The movable connector 51 protrudes the male connector portion 60 from the frame 59, and the terminal-equipped wire 61 of the male connector portion 60 is guided out through the panel hole 62. The one elastic arm 63 is engaged with the panel hole 62, whereas the other elastic arm 64 abuts on the panel portion 65 to urge the movable connector 51 forward. A protrusion 67 of the guiding cylinder 66 of the movable connector 51 is provisionally engaged with a window 68 of the cylinder 55 of the fixed connector 53, and the bolt 69 has gone to the nut 70. These movable connector 51 and fixed connector 53 have the same structure as in the first embodiment.

By the rotating operation of the bolt 69, i.e. coupling between the bolt 69 and nut 70, as shown in FIG. 10, the movable connector 51 is attracted to the fixed connector 53 as indicated in arrow a so that the front abutting face 59*a* of the frame 59 goes to the rear end 47*b* of each sandwiching plate 47. Thus, the sandwiching plates 47 are sandwiched between the circuit board 56 of the fixed connector 53 and abutting face 59*a* of frame 59 of the movable connector 51.

Accordingly, the meter unit 48 is firmly secured to the instrument panel 49. The pair of sandwiching plates 47 are located between the central guiding cylinder 66 of the movable connector 51 and the male connector portions 60 on both sides, and hence accommodated between the central cylinder 55 of the fixed connector 53 and female connector portions 54 on both sides.

Incidentally, the brackets 72, 73 and bolt 74 serve to secure the upper portion of meter unit where the connectors 51 and 53 are not arranged on the instrument panel 49. Some elastic members (not shown) may be provided at front and rear ends of each sandwiching plate 47.

Arranging the sandwiching plates 47 inside the connectors 51 and 53 can save the inner space of the meter unit mounting 50. In addition, supporting the left and right sides of the connectors 51 and 53 by the pair of sandwiching plates 47 stabilizes the securing attitude of the connectors 51 and 53.

What is claimed is:

1. A securing structure for a unit component comprising:

a first connector provided on an instrument panel;

a second connector provided on the unit component;

said first and said second connectors being connected to each other by tightening of a screw means; and a sandwiching plate formed on said instrument panel, said sandwiching plate being sandwiched by said first and second connectors so that said unit component is secured onto said instrument panel.

2. A securing structure for a unit component according to claim 1, further comprising an elastic member covering said sandwiching plate, said elastic member being sandwiched by said first and second connectors (connector).

3. A securing structure for a unit component according to claim 1, wherein said sandwiching plate is extended in a direction of coupling said first and second connectors to each other, and is located inside said first connector.

4. A securing structure for a unit component according to claim 2, wherein said sandwiching plate is extended in a direction of coupling said first and said second connectors to each other, and is located inside said first connector.

* * * * *